United States Patent [19]

Dumortier

[11] Patent Number: 4,508,469

[45] Date of Patent: Apr. 2, 1985

[54] MANHOLE WITH ARTICULATED COVER MEMBERS

[76] Inventor: Robert Dumortier, 9 rue Duchartre, 34500 Beziers, France

[21] Appl. No.: 457,147

[22] Filed: Jan. 11, 1983

[30] Foreign Application Priority Data

Jan. 14, 1982 [FR] France ..... 82 00769

[51] Int. Cl.[3] ..... E02D 29/14

[52] U.S. Cl. ..... 404/25; 52/19

[58] Field of Search ..... 404/25, 26; 52/19, 20, 52/21; 137/364, 371; 210/163, 164, 165, 166; 49/463, 397

[56] References Cited

U.S. PATENT DOCUMENTS

| | | | |
|---|---|---|---|
| 1,923,481 | 8/1933 | Ford | 404/25 X |
| 2,003,770 | 6/1935 | Goodhart | 210/163 |
| 2,845,665 | 8/1958 | Place | 49/397 |
| 2,997,932 | 8/1961 | Taylor | 404/26 |
| 3,455,059 | 7/1969 | Evans | 404/25 X |

FOREIGN PATENT DOCUMENTS

| | | | |
|---|---|---|---|
| 7906566 | 11/1980 | France . | |
| 24177 | of 1906 | United Kingdom | 404/25 |
| 366700 | 2/1932 | United Kingdom | 404/25 |
| 415075 | 8/1934 | United Kingdom | 404/25 |
| 2096216 | 10/1982 | United Kingdom | 52/20 |

*Primary Examiner*—Stephen J. Novosad
*Assistant Examiner*—Beverly E. Hjorth
*Attorney, Agent, or Firm*—Karl F. Ross; Herbert Dubno

[57] ABSTRACT

A manhole structure comprising a circular frame formed with a pair of diametrically opposite inwardly and upwardly open recesses traversed by respective pivot pins and a further pair of diametrically opposite brackets having inwardly and upwardly open recesses. A pair of semicircular cover heads, each has three radially projecting lugs including a pivot lug engaging a respective one of the pins and a pair of support lugs at opposite ends of the rectilinear edge of the cover half. The pivot lug has a pocket receiving the pin and communicating with a narrow slot whereby the pivot lug is inserted over the pin, the pocket being shaped so that when the cover is swung open, it can be braced between the pin and an edge of the recess. All of the recesses have wedge-forming inclined flanks which engage inclined flanks of the cover halves to support the latter in their closed positions.

3 Claims, 8 Drawing Figures

MANHOLE WITH ARTICULATED COVER MEMBERS

FIELD OF THE INVENTION

This invention relates to a circular inspection hole (manhole) for a roadway with articulated half-pads forming a cover.

BACKGROUND OF THE INVENTION

Roadway inspection holes generally consist of a frame fastened to the roadway and of a removable pad. In order to gain access to the subsurface structure through the inspection hole, the cover must be removed. This operation is inconvenient whatever the weight of the pad may be. The same applies when the pad is to be put back into the frame.

Furthermore, in order to prevent the pad from being uplifted when a heavy vehicle passes above it, thereby giving rise to a strong vertical suction, and also in order to prevent any accident as the inspection hole is opened, heavy and massive pads, held in place only by their weight, are being progressively replaced by articulated pads of the type described in British Pat. No. 474,250 and in French patent application No. 79.06566. Experience has shown that it is desirable, on the one hand, to facilitate the opening and closure operations of the pads by controlling the pivoting movements and, on the other hand, to prevent the articulating means from being clogged up by earth or other waste material which might come into the fissures of the inspection hole and thus might interfere with their operation.

Manholes are known, in particular from U.S. Pat. No. 2,997,932, which comprise two half-pads each shaped as a right angled isosceles triangle, which are placed side by side on the frame through their hypotenuse and are provided, within the latter's extension and that of their angle, with radial lugs of trapezoidal section resting on bearings with a V-shaped complementary section. In this arrangement, each half-pad rests on the frame at only three points which gives it excellent stability and prevents it from producing noises when heavy vehicles are passing over.

OBJECT OF THE INVENTION

The object of this invention is to provide a roadway inspection hole (manhole) which, although it possesses the advantages of articulated pads and half-pads resting on three bearing points, without at the same time giving rise to difficulties in construction or use, will not run the risk of producing noises resulting from faulty bearings on the frame.

SUMMARY OF THE INVENTION

The manhole of the invention comprises two half-pads articulated on a frame, each of these half-pads having three radial pegs or projections which are respectively lateral and posterior, the lower part of which is provided with angle blocks which may rest on V-shaped positioning faces provided in the frame bracket.

According to the invention, the horizontal articulation axis of each half-pad crosses the posterior bracket with which it is integral, whereas the posterior radial peg is provided with an internal housing profiled as a cam the profile of which is set so that, in the closure position, the horizontal will be out of contact with the housing, but during the opening operation, will control the motion of this half-pad, first alone and subsequently over the remainder of the motion, in combination with the posterior rim of the pad as it comes to bear against the wall and the bottom of the bracket.

The shape of the housing for the pivot pin therefore makes it possible to impart a stable position to the corresponding half-pad both when it is in the open position and in the closure position at rest on the V-shaped bearings.

The angle formed by the faces of each of the V-shaped housings of the brackets is advantageously less by several degrees than that formed by the complementary faces of the corresponding peg.

Because of this arrangement, the contact faces of the various bearings become adjusted to one another by a wedging action which improves the contact and stability of the half-pad. Furthermore, when the half-pad is tipped from its opening position to its closure position without being restrained, the energy which is imparted to it makes it possible for these pegs to be wedged in the V components of the frame and to thus ensure the locking through wedging of this half-pad.

BRIEF DESCRIPTION OF THE DRAWING

Other characteristics and advantages will become evident from the following description referring to the appended drawing which shows, by way of a non-limiting example, an embodiment of this roadway inspection hole.

In the drawing.

SPECIFIC DESCRIPTION

Figure 1:
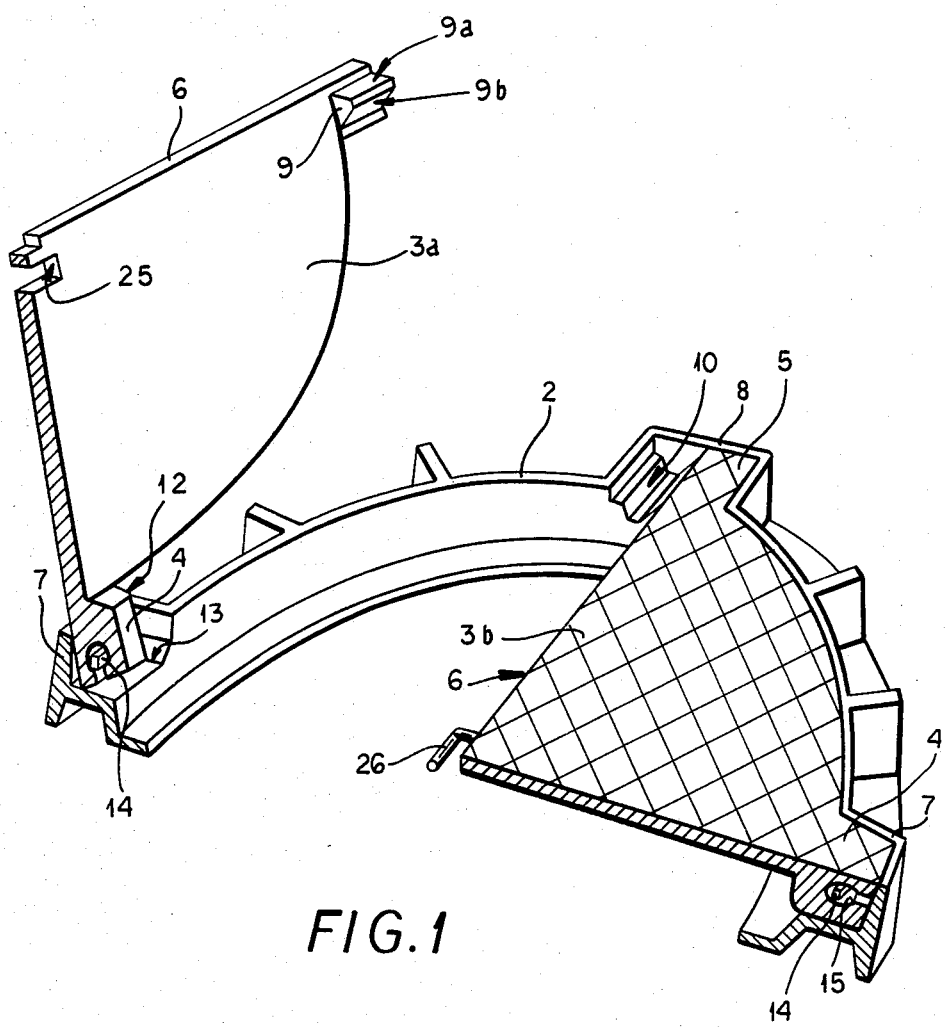
FIG. 1 is a partial perspective view of the manhole of the invention, one of the half-pads being in the opening position and the other one in the closure position.
Figure 2:
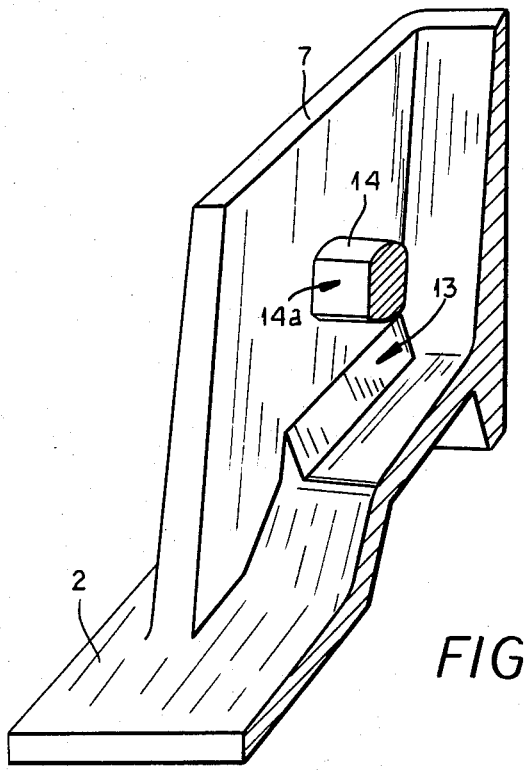
FIG. 2 is a partial side view showing, as a section and on an enlarged scale, an embodiment of the bracket and pin provided in the frame in order to receive the articulation peg.
Figure 3:
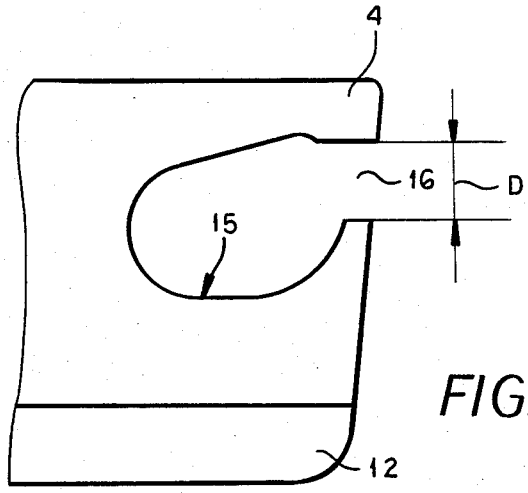
FIG. 3 is a partial side view showing, on an enlarged scale, the housing provided in the articulation peg.

As shown in FIG. 1, in a plan view from above, the circular inspection hole or manhole of the invention consists of a frame 2 and two half-pads 3*a*–3*b* each having a semi-circular shape. Each pad is provided with three radial pegs or projections, i.e.: a posterior articulation peg or pivot line 4 and two lateral positioning pegs 5. The articulation peg 4 projects is perpendicular to the rectilinear rim 6 of the corresponding half-pad, whereas the longitudinal axes of the two positioning pegs or support lines 5 are substantially parallel to this rectilinear rim. The two positioning pegs 4 are received in posterior radial brackets 7 of the frame 2. These two brackets are diametrically opposed and formed as upwardly and inwardly open recesses. With regard to the positioning pegs 5, they penetrate into brackets 8, which are also diametrically opposed and substantially displaced by 90° with respect to brackets 7. Each bracket 8 is provided so as to simultaneously receive the positioning pegs 5 of the two half-pads.

The positioning pegs 5 are provided with contact and positioning faces which can cooperate with complementary faces provided in the corresponding bracket 8. In the embodiment shown, these contact and positioning faces 9a–9b form a wedge 9 which can penetrate into the V-shaped seat 10 provided in the corresponding bracket 8. Similarly, the articulation peg 7 is provided, at its base, with two inclined lateral faces 12 imparting to it a truncated V shape. These faces are designed to cooperate with inclined faces 13 defining a V at the bottom of corresponding bracket 7.

The angle formed by the faces of each of the V-shaped seats 10 of brackets 8, as well as the one formed by faces 13 of brackets 7, has a value which is less, by several degrees, than that of the angle formed by the complementary faces, respectively 9a–9b and 12, of the corresponding pegs. This arrangement makes it possible for the contact faces to shape themselves spontaneously and thus improves the stability of the inspection hole. Furthermore, it makes it possible to obtain a wedging effect which helps maintain the half-pads in a closed position, even when a vehicle of high tonnage passes over the inspection hole.

The articulation of each articulation peg 4 on the frame 2 is provided by a horizontal pivot pin 14 which traverses the bracket with which it is integral. This pivot can be provided as an insert or be molded into the frame. This pin goes through a pocket 15 of peg 4 in a crosswise direction, the internal wall of which housing has a cam shaped profile the utility of which will be specified below. The pocket 15 communicates with the outside through a slot 16 provided in its posterior part the opposite faces of which are separated by a distance D which is at least equal to that d separating two parallel and vertical flats 14a provided on pin 14. This arrangement makes it possible to remove the half-pads in case of need, but also to replace them easily if they are damaged or partially broken.

Figure 4:
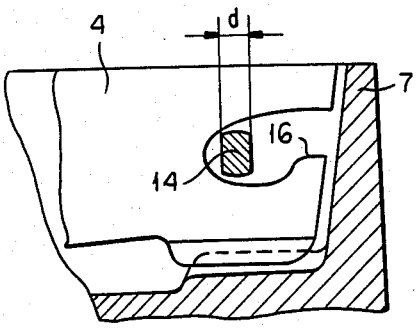
FIGS. 4 and 8 are partial sectional side views showing, for different positions of an articulated half-pad, the areas of contact of the articulation peg housing with the axis of the bracket.

As shown in greater detail in FIG. 4 and in order to avoid disturbing the stability of each half-pad provided by its three V-shaped bearings and, especially, to avoid disturbing the V-shaped bearing of the articulation peg 4 at the bottom of bracket 7, the wall of housing 15 is provided so as not to come into contact with axis 14.

Figure 5:
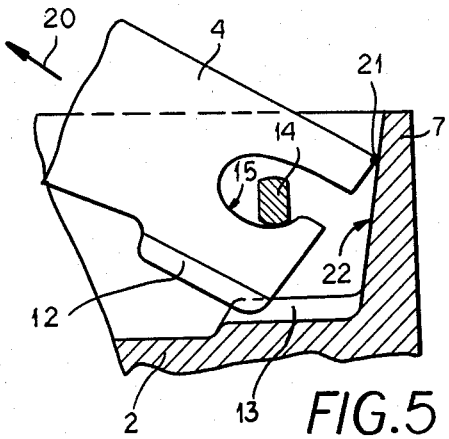
Figure 6:
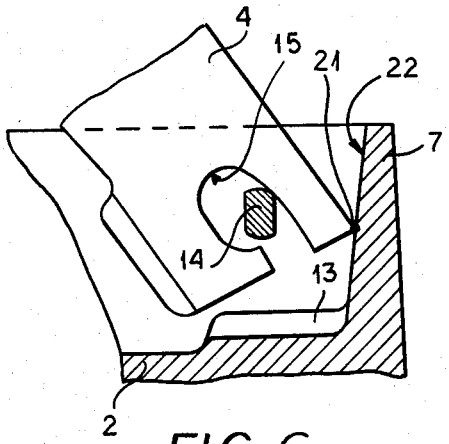
Figure 7:
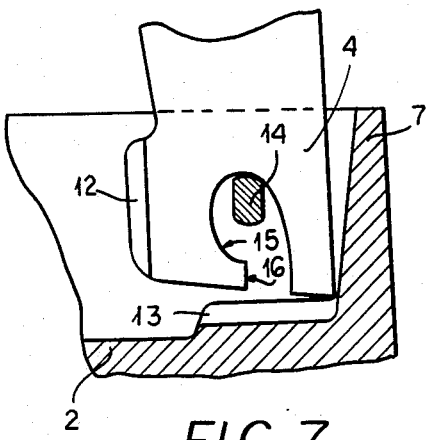
Figure 8:
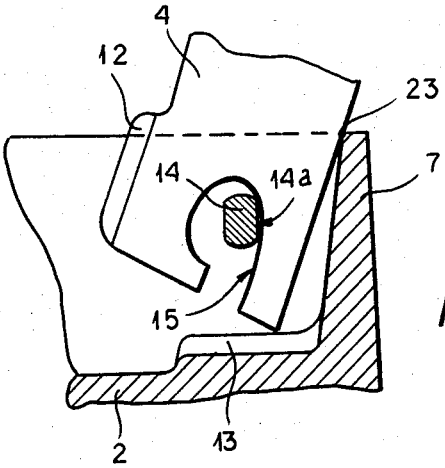

When one of the half-pads is swung in the opening direction, it is simultaneously subjected to a translation in the direction of the arrow 20 of FIG. 5 until the pin 14 comes into contact with the posterior part of the cam-shaped profile of the pocket 15, as shown in that Figure. From that moment on, the pivoting action occurs around the lower part of the pin 14 until the posterior rim or edge 21 of peg 4 encounters the posterior wall 22 of bracket 7, as shown in FIG. 5. At this stage, the pivoting is guided by the contact of the rim 21 on the wall 22 until, as shown in FIG. 6, the upper part of the axis comes into contact with the upper profile of the pocket 15, and then with the forward profile (FIG. 7) in order to control the pivoting. As soon as the inspection hole goes beyond the vertical position, it takes up an inclined position beyond the latter, of the order of 18° to 15°. In that position, as shown in FIG. 8, the peg 4 bears against the upper posterior ridge or edge 23 of bracket 7 and through the face of its pocket 15, against the posterior flat 14a of the pin 14. Because of these two contacts, the half-pad occupies a perfectly stable opening position which prevents its accidental closure.

It is clear that in the closure motion, the various parts of the pocket 15 cooperate in an inverse manner with the pivot 14. It should be noted, however, that at the end of the closure movement, the introduction of the positioning pegs 5 into the V-shaped components 10, induces the crosswise displacement of the half-pad so that the pocket 15 occupies the position, as shown in FIG. 4, in which the wall thereof is out of contact with axis 14 so as not to disturb the bearing of the faces 12 inclined on those 13 of bracket 7.

As shown in FIG. 1, the half pad 3a comprises an opening 25 for the passage of a pointed tool such as the pick of a pickaxe, whereas half-pad 3b is provided with a handle 26 facilitating its elevation.

It should be noted that, because of the correct guidance of the tipping operation, ensured by the cooperation of the various parts of the pin 14 with the profile of the pocket 15, the closure operation does not require the restraint of the half-pad, so that it can occur very rapidly by the simple thrust of this half-pad, which, furthermore, facilitates the wedging of the positioning pegs 5 in the V-shaped component 10 as well as the locking of this half-pad.

It is clear from the above that, because of its structure and, in particular, through the use of two positioning pegs and of an articulation peg provided with a cam-shaped profile cooperating with the axis of rotation, this roadway inspection hole is very easy to manipulate, both with regard to opening and closure, ensures the safety of the personnel when it is in the opened position without any other accessories being necessary and has, in the closed position, an excellent stability which prevents it from tipping when vehicles are passing over it and, as a result, from producing noises.

In addition, due to the total sealing of the brackets 7 by the corresponding pegs 4, the articulation of each half-pad is protected and does not run the risk of being clogged by earth or other waste material, as in the case with other pads, which guarantees the correct operation of the pad in the course of time.

I claim:

1. A manhole structure comprising:

a circular frame formed with a pair of diametrically opposite inwardly and upwardly open pivot recesses and a pair of diametrically opposite upwardly and inwardly open support recesses at right angles to said pivot recesses, each of said pivot recesses being spanned by a respective pivot pin; and a pair of semicircular cover halves each having a rectilinear edge adjoining the rectilinear edge of the other cover half in a closed position of said covers, a radially projecting pivot lug received in the respective pivot recess and formed with a pocket traversed by the respective pin, and a slot of a width narrower than said pocket and narrower than at least a portion of the respective pin communicating with the respective pocket and enabling the respective pin to pass through the respective slot into the respective pocket in a selected angular position of the respective cover half and the respective pin, each of said cover halves being further formed with a pair of support lugs projecting along the respective edge and receivable in the respective support recesses, each of said lugs being provided with downwardly divergent inclined resting flanks and each of said recesses being provided with upwardly divergent inclined supporting flanks engageable with the resting flanks of a respective lug in a closed position of the respective cover half and supporting the three lugs of each cover half so that the respective pin is out of contact with the wall of the respective pocket, the pocket, the pin received therein and the pivot recess thereof being shaped so that each pocket forms a cam guiding the respective pivot lug along the respective wall at least during opening of each cover half so that each cover half is retained in a stable partially rearwardly inclined open position with said wall bearing against said pin and the respective pivot lug resting against the respective edge of the respective pivot recess in an open position of the respective cover half, said cam inducing radial displacement of each cover half relative to the frame during the opening of each cover half and the said pivot lug of each cover half being the sole pivot lug thereof.

2. The manhole structure defined in claim 1 wherein said pin has a pair of flats spaced apart by a distance less than the diameter of said pin and said slot has a width at least equal to the spacing between said flats but less than said diameter.

3. The manhole structure defined in claim 1 wherein the angle included between the support flanks of each recess is several degrees smaller than the angle included between the resting flanks of the respective lug.

* * * * *